United States Patent [19]

Uzrad

[11] Patent Number: 4,684,066

[45] Date of Patent: Aug. 4, 1987

[54] FLEXIBLE TUBE SPRINKLER

[76] Inventor: Mordechai Uzrad, Moshav Ein-Ayala, D.N. Hof HaCarmel 30 825, Israel

[21] Appl. No.: 767,908

[22] Filed: Aug. 21, 1985

Related U.S. Application Data

[63] Continuation-in-part of Ser. No. 507,153, Jun. 23, 1983, abandoned.

[30] Foreign Application Priority Data

Mar. 22, 1985 [IL] Israel ..... 74688

[51] Int. Cl.[4] ..... B05B 1/28; B05B 3/00

[52] U.S. Cl. ..... 239/229; 239/121

[58] Field of Search ..... 239/121, 229

[56] References Cited

U.S. PATENT DOCUMENTS

| | | | |
|---|---|---|---|
| 928,372 | 7/1909 | Fisher | 239/229 |
| 1,534,208 | 4/1925 | Gibson | 239/121 X |
| 2,601,655 | 6/1952 | Young | 239/229 |
| 2,620,231 | 12/1952 | King | 239/229 |
| 2,999,644 | 9/1961 | Nobinger | 239/229 |
| 4,044,953 | 8/1977 | Vogel | 239/229 |
| 4,178,949 | 12/1979 | Mazon, III | 239/229 X |
| 4,235,378 | 11/1980 | Melin et al. | 239/229 |

FOREIGN PATENT DOCUMENTS

| | | | |
|---|---|---|---|
| 545196 | 8/1957 | Canada | 239/229 |
| 331141 | 7/1958 | Switzerland | 239/121 |
| 17834 | of 1888 | United Kingdom | 239/229 |
| 755314 | 1/1978 | U.S.S.R. | 239/229 |

*Primary Examiner*—Andres Kashnikow
*Assistant Examiner*—Patrick N. Burkhart
*Attorney, Agent, or Firm*—Benjamin J. Barish

[57] ABSTRACT

A flexible tube sprinkler comprises a connector at one end, a nozzle at the opposite end, and a flexible tube between the connector and nozzle permitting free movement of the nozzle by the weight thereof and by the reaction forces of the water discharged therefrom. Enclosing the connector end of the flexible tube is a rigid sleeve having an axial bore of larger diameter than the external diameter of the connector end of the flexible tube such that there is a clearance between the inner face of the rigid sleeve and the outer face of the connector end of the flexible tube permitting the rigid sleeve to be impacted by the flexible tube during the operation of the sprinkler to control the movements of the flexible tube and thereby the distribution of the water discharged from the nozzle.

16 Claims, 7 Drawing Figures

FLEXIBLE TUBE SPRINKLER

RELATED APPLICATION

The present application is a continuation-in-part of U.S. patent application Ser. No. 507,153, now abandoned.

BACKGROUND OF THE INVENTION

The present invention relates to flexible tube sprinklers, and particularly to the type of sprinkler which, during its operation, is freely movable in the lateral direction by the weight of the sprinkler nozzle and the reaction forces of the water discharged therefrom, to distribute the water laterally around the sprinkler.

A large number of flexible tube sprinklers of the foregoing type have been proposed in the past, as for example described in U.S. Pat. Nos. 530,464, 586,161, 2,620,231, 2,700,527, 3,325,102, 3,587,972 and 3,633,826. However, insofar as I am aware, no flexible tube sprinkler has yet gained widespread use, probably because the previously known flexible tube sprinklers have suffered from one or more of the following drawbacks: insufficient range, requirement for high pressure, unsatisfactory water distribution, undue sensitivity to changes in water pressure causing unsatisfactory change in range/or distribution, and too rapid movements of the sprinkler causing accelerated depreciation.

An object of the present invention is to provide a flexible tube sprinkler having advantages in one or more of the above respects.

SUMMARY OF THE INVENTION

According to a broad aspect of the present invention, there is provided a flexible tube sprinkler comprising a connector at one end for connecting same to a source of pressurized water, a nozzle at the opposite end for discharging the water, and a flexible tube between said connector and nozzle permitting free movement of the nozzle by the weight thereof and by the reaction forces of the water discharged therefrom; characterized in that the sprinkler further includes a rigid sleeve enclosing the connector end of the flexible tube, the rigid sleeve having an axial bore therethrough of larger diameter for its complete length than the external diameter of the connector end of the flexible tube such that there is a clearance space between the complete length of the inner face of the rigid sleeve and the outer face of the connector end of the flexible tube permitting the rigid sleeve freely to move laterally, rotatably and axially with respect to the flexible tube and to be impacted by the flexible tube during the operation of the sprinkler to control the movements of the flexible tube and thereby the distribution of the water discharged from the nozzle.

In the preferred embodiments of the invention described below, the flexible tube is preferably formed with an annular shoulder engageable with the downstream end of the rigid sleeve to limit the axial movements of the sleeve during the operation of the sprinkler.

In some described embodiments, the downstream end of the rigid sleeve is cut at a bias to cause the discharged water to trace circular patterns of different configurations and thereby to increase the uniformity of distribution of the water in the water-wetted area around the sprinkler.

Some described embodiments further include a second rigid sleeve having its inner end fixed to the nozzle and its outer end projecting outwardly therefrom, the second rigid sleeve having a bore of larger diameter than the discharge opening of the nozzle.

Other preferred features included in some of the described embodiments are the provision of: a weight adjacent to the nozzle end of the flexible tube; a restriction in the passageway and a plurality of radially-extending openings immediately upstream of the restriction for discharging small quantities of water radially of the flexible tube; a further rigid sleeve slidably received on the flexible tube adjacent to the nozzle end thereof; and a stop laterally of the flexible tube and engageable thereby during the operation of the sprinkler to restrict the free movements of the flexible tube and thereby to produce an unequal distribution of the water around the sprinkler, for example to effect a sector distribution rather than an annular distribution of the water.

It has been found that flexible tube sprinklers can be constructed in accordance with one or more of the above-described features to correct some or all of the above-mentioned deficiencies of the previously-proposed flexible tube sprinklers.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
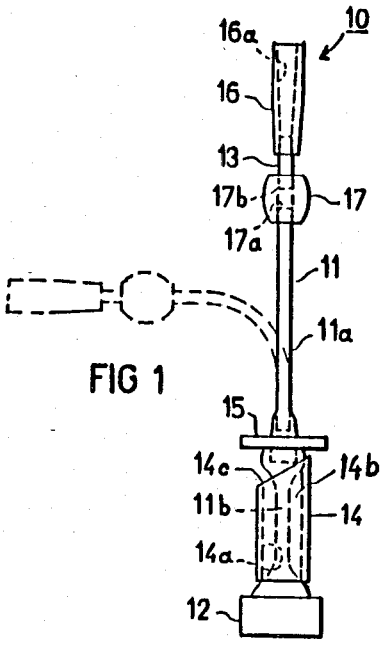
FIGS. 1–6 are side-elevational views illustrating six constructions of flexible tube sprinklers constructed in accordance with the present invention.

The sprinkler illustrated in FIG. 1, and therein generally designated 10, includes a flexible tube 11 carrying at one end a connector 12 for connection to a source of pressurized water and a nozzle 13 at its opposite end for discharging the water. As known in flexible tube sprinklers of this type, connector 12 is adapted to be connected to a vertical riser, with the flexibility of tube 11 permitting the tube to droop towards a horizontal position, such that the reaction forces of the water discharged through nozzle 13 during the operation of the sprinkler causes the nozzle end of the sprinkler to freely move around the vertical axis of the riser in a substantially circular manner and thereby to distribute the water annularly around the sprinkler. Theoretically, such a flexible tube sprinkler has many advantages over conventional rotary sprinklers in that it obviates the need for a sealed rotary joint between the riser tube and the rotating nozzle, but nevertheless such flexible tube sprinklers have not yet gained widespread use because of the drawbacks discussed earlier.

The flexible tube sprinkler illustrated in FIG. 1 includes a number of features which avoid many of these drawbacks.

One of the important features in the sprinkler illustrated in FIG. 1 is the provision of a rigid sleeve 14 enclosing the connector end of the flexible tube 11. In the embodiment illustrated in FIG. 1, flexible tube 11 is constituted of two flexible tube sections **11*a*, 11*b* joined together by a member 15 which serves as a stop for limiting the axial movement of rigid sleeve 14** during the operation of the sprinkler.

Thus, rigid sleeve 14 has an axial bore 14*a* of a larger diameter than the external diameter of flexible tube section 11*b* which it encloses, such that there is a clearance 14*b* between the inner face of the rigid sleeve and the outer face of the flexible tube. This permits the rigid sleeve 14 to be freely movable with respect to the flexible tube section 11*b* in the rotary, lateral, and axial directions, the latter being limited by stop 15. The upper (downstream) edge of rigid sleeve 14, which engages stop 15, is cut at a bias as shown at 14*c*.

The flexible tube sprinkler 10 illustrated in FIG. 1 includes a second rigid sleeve 16 fixed at one end to the sprinkler nozzle 13. Sleeve 16 is longer than nozzle 13, so that the outer end of sleeve 16 projects considerably past nozzle 13. Sleeve 16 is formed with a bore 16*a* of larger diameter than the discharge opening of nozzle 13. In the arrangement illustrated in FIG. 1, bore 16*a* in sleeve 16 is of conical configuration, increasing in diameter from its inner end to its outer end.

Sprinkler 10 illustrated in FIG. 1 further includes a weight 17 adjacent to the sprinkler nozzle 13. Weight 17 may be of metal. It is formed with a bore terminating in sockets at its opposite end, one socket 17*a* receiving the upper (downstream) end of flexible tube section 11*a*, and the other socket 17*b* receiving the sprinkler nozzle 13.

The flexible tube sprinkler 10 illustrated in FIG. 1 has been found to provide a number of important advantages.

Thus, when the sprinkler is attached by its connector 12 to the vertical riser pipe in a water irrigation system, weight 17, together with the weight of rigid sleeve 16 at the outer end of the sprinkler, causes the flexible tube section 11*a* to droop such as to bring nozzle 13 and the outer rigid sleeve 16 towards the horizontal. This drooping of the flexible tube sprinkler, however, is limited by the inner rigid sleeve 14.

During the operation of the sprinkler, the reaction forces produced by the water discharged from nozzle 13 causes the flexible tube 11 to freely move in all the lateral directions. The lower rigid sleeve 14, however, is impacted by the flexible tube and thereby constrains its movements movements to circular movements around the sprinkler. During these movements of flexible tube section 11*a*, and to a lesser extent flexible tube section 11*b*, rigid sleeve 14 is also free to move rotationaly around section 11*b*, laterally of that section, and also axially of that section. The axial movements are limited by edge 14*c* of the sleeve engaging stop 15. The point of engagement of edge 14*c* with stop 15 determines the diameter of the circular water-discharge pattern. Since edge 14*c* is cut at a bias in the embodiment of FIG. 1, this circular distribution pattern will vary in diameter according to the rotational position of the sleeve, and therefor the water discharge patterns will vary in diameter with the rotation of the sleeve. This has been found to produce more uniformity in the annular area around the sprinkler wetted by the water discharged from the sprinkler.

The provision of the outer rigid sleeve 16 has been found to reduce the water pressure required in order to effect rotation of the sprinkler. The provision of the sleeve has also been found to effect a more uniform distribution of the water in the annular area around the sprinkler particularly when its bore 16*a* is larger than the nozzle discharge bore, and also when bore 16*a* is of increasing diameter from its inner to its outer end as shown in FIG. 1.

Figure 2:
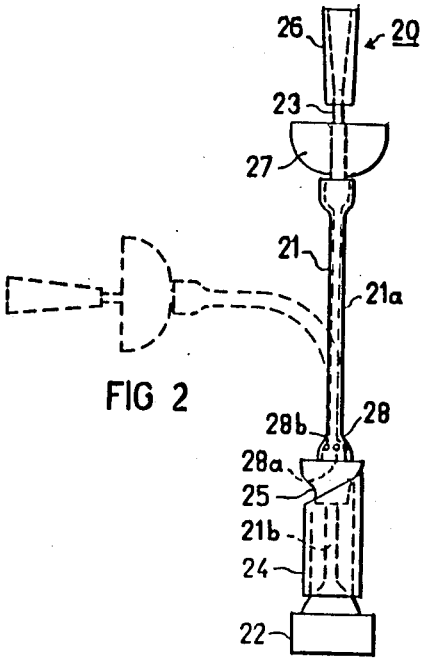

The sprinkler illustrated in FIG. 2 is similar to that of FIG. 1, including a flexible tube 21 carrying a connector 22 at one end, and a nozzle 23 at the opposite end, a freely-movable rigid sleeve 24 enclosing section 21*b* of the flexible tube at its connector end, a stop 25 limiting the axial movement of sleeve 24, an outer rigid sleeve 26 fixed to its nozzle 23, and a weight 27 adjacent to the nozzle, all as described above with respect to FIG. 1. In the sprinkler of FIG. 2, however, a member 28 is inserted between stop 25 and flexible tube section 21*a*. Member 28 is formed with a bore 28*a* of larger diameter than that in flexible tube section 21*a*, so that a restriction is created as the water passes from bore 28*a* of member 28 to the bore of flexible tube section 21*a*. In addition, member 28 is formed with a plurality of radially-extending holes 28*b*.

Thus, as the water passes from member 28 to flexible tube section 21*a*, the restriction reduces the flow rate and therefore the pressure in bore 28*a* of member 28 upstream of this restriction is increased, so that some of the water is discharged in the radial direction through openings 28*b* during the operation of the sprinkler. This arrangement has been found to further improve the distribution of the water in the annular area around the sprinkler.

Figure 3:
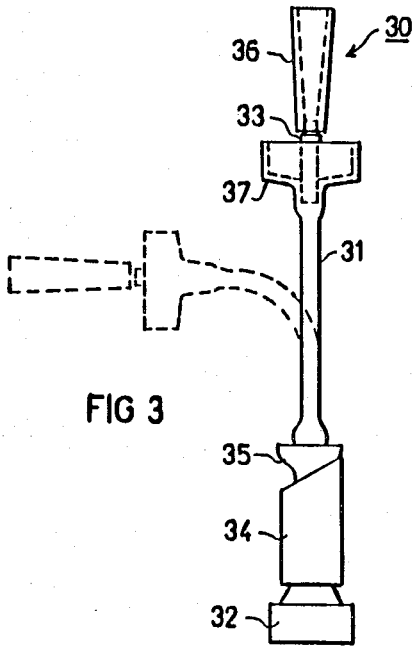

FIG. 3 illustrates a flexible tube sprinkler 30, also similar to sprinkler 10 of FIG. 1, (or to sprinkler 20 of FIG. 2), including elements 31, 32, 33, 34, 35 and 36, corresponding to elements 11, 12, 13, 14, 15 and 16 in FIG. 1. In FIG. 3, however, the weight adjacent to the nozzle 33 is in the form of a cup 37 which tends to accumulate some water discharged from nozzle 33. Cup 37 thereby serves as the equivalent of weight 17 or 27 in the sprinklers of FIGS. 1 and 2.

Figure 4:
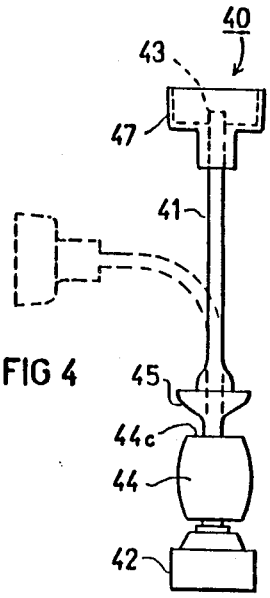

FIG. 4 illustrates a sprinkler 40 similar to that of FIG. 3 and including elements 41, 42, 43, 44, 45 and 46, corresponding to elements 31, 32, 33, 34, 35 and 36 of FIG. 3. In the embodiment of FIG. 4, however, the outer sleeve (36 in FIG. 3) is omitted. In addition, the upper edge 44*c* of the inner rigid sleeve 44 is not cut at a bias, as in FIGS. 1–3, but rather is cut perpendicularly to its axis. In all other respects, the sprinkler 40 illustrated in FIG. 4 is of the same construction and operates in the same manner as described above.

Figure 5:
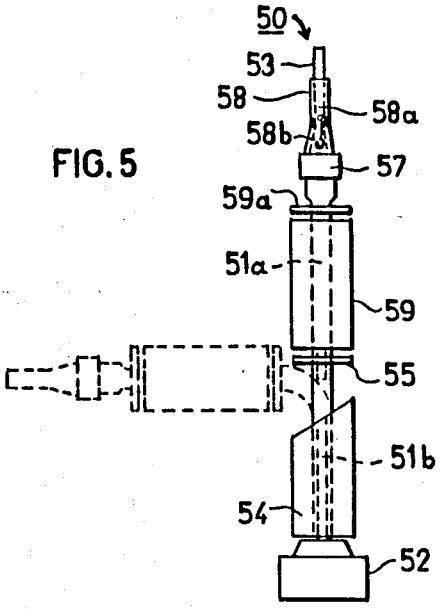

FIG. 5 illustrates a sprinkler 50 which is of similar construction as described above but includes a number of additional features. The features in sprinkler 50 which are in common with those described above include the flexible tube sections 51*a*, 51*b*, connector 52, nozzle 53, freely-movable rigid sleeve 54 at the connector end, stop 55 limiting the axial movement of sleeve 54, and weight 57, corresponding to elements 11*a*, 11*b*, 12, 13, 14, 15 and 17 in FIG. 1. The outer rigid sleeve 16 in FIG. 1 is not shown in FIG. 5, but could be included if desired.

Sprinkler 50 illustrated in FIG. 5 also includes a member, therein designated 58, for producing the radial discharges of water during the operation of the sprinkler, similar to member 28 in FIG. 2 but at a different location; in addition, sprinkler 50 of FIG. 5 includes an additional freely-moving rigid sleeve 59 enclosing the upper (downstream) flexible tube section 51*a*.

More particularly, the radial-discharge member 58 included in sprinkler 50 of FIG. 5 is provided adjacent to the nozzle 53 of the sprinkler, rather than adjacent to the connector 22 as in FIG. 2. This member 58 includes a bore 58*a* which is of larger diameter than that of nozzle 53 so as to impose a restriction to the flow of the water into the nozzle. In addition, member 58 is formed with a plurality of radial discharge openings 58*b* upstream of this testriction to cause a radial discharge of water via these openings during the operation of the sprinkler.

The additional rigid sleeve 59, enclosing the upper flexible tube section 51*a*, is also freely movable with respect to that section in the rotary, lateral and axial directions, as rigid sleeve 54 enclosing the lower flexible tube section 51*b*. The axial movements of sleeve 59 are limited by stop 55 which also acts against the lower sleeve 54, and by an additional stop 59*a* at the opposite side of sleeve 59. Sleeve 59 is dimensioned to permit axial movement of the sleeve between these two stops.

It has been found that the provision of this additional rigid sleeve 59 further lowers the pressure needed to rotate the sprinkler, and the provision of the radial discharge openings 58*b* closer to the nozzle 53 improves the distribution of the water over the annular area around the sprinkler during its operation.

Figure 6:
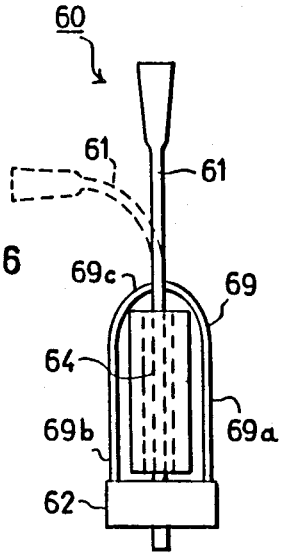

FIG. 6 illustrates a flexible tube sprinkler, generally designated 60, which may be of any of the above-described constructions, and therefore details of its construction are not shown in FIG. 6. Sprinkler 60 illustrated in FIG. 6 differs from the other constructions in the provision of a stop member, therein designated 69, laterally of the flexible tube section 61 of the sprinkler so as to be engageable thereby during the operation of the sprinkler. The provision of this stop member 69 converts the sprinkler to one producing a sector distribution pattern, rather than an annular distribution pattern, since it restricts the free movement of the flexible tube 61 during the operation of the sprinkler.

More particularly, stop member 69 is of U-shaped configuration, including a pair of legs 69*a*, 69*b* fixed to connector 62, and a bridging portion 69*c* extending past the upper (downstream) end of the freely-movable rigid sleeve 64. Bridge portion 69*c* is disposed laterally on one side of flexible tube 61 in order to restrict the free movements of the flexible tube during the operation of the sprinkler, to movements only on one side of this bridge portion. Thus, the water will be distributed only on that side of the sprinkler.

It will be appreciated that blocking member 69 may be of other configuration and may restrict the water distribution to any desired pattern, according to the particular application.

Figure 7:
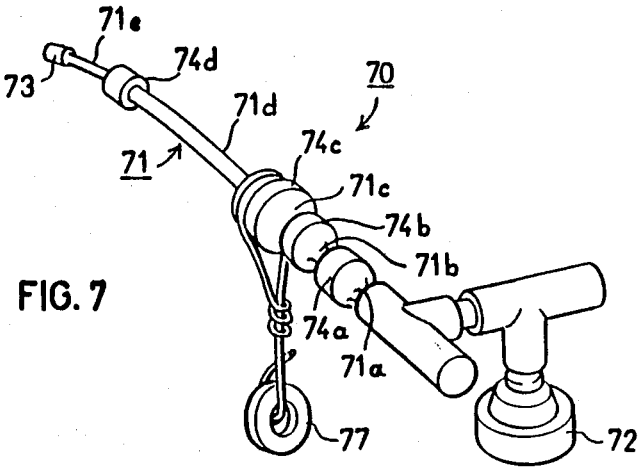
FIG. 7 illustrates a further construction.

The sprinkler illustrated in FIG. 7, and therein generally designated 70, also includes a flexible tube 71 carrying at one end a connector 72 for connection to a source of pressurized water, and a nozzle 73 at its opposite end for discharging water. In this case, however, the flexible tube 71 is normally disposed in a substantially horizontal position, and is formed with a plurality of flexible tube sections 71*a*, 71*b*, 71*c*, 71*d* and 71*e*, between its inlet connector 72 and its outlet nozzle 73, each section being coupled to the next one by a coupling sleeve 74*a*, 74*b*, 74*c*, and 74*d*. A weight 77 is suspended from a mid-portion of the flexible tube 71, in this case the weight being suspended from coupling sleeve 74*c*.

In the absence of weight 77, the reaction forces produced by the discharge of the water via its nozzle 73 would cause the flexible tube 71 to move in two planes, i.e. both the horizontal plane and the vertical plane, in most cases tracing something approximate to a figure-eight path. However, when weight 77 is added, it was found that the reaction forces cause the flexible tube 71 to oscillate in one plane, substantially the horizontal plane, thereby making the illustrated sprinkler particularly useful in sector sprinkling wherein the ground to be wetted occupies a sector of a circle.

While the invention has been described with respect to a number of preferred embodiments, it will be appreciated that many other variations, modifications and applications of the invention may be made.

What is claimed is:

1. A flexibe tube sprinkler comprising a connector at one end for connecting same to a source of pressurized water, a nozzle at the opposite end for discharging the water, and a flexible tube between said connector and nozzle permitting free movement of the nozzle by the weight thereof and by the reaction forces of the water discharged therefrom; characterized in that said sprinkler further includes a rigid sleeve enclosing the connector end of said flexible tube, said rigid sleeve having an axial bore therethrough of larger diameter for its complete length than the external diameter of the connector end of the flexible tube such that there is a clearance space between the complete length of the inner face of said rigid sleeve and the outer face of said connector end of the flexible tube permitting said rigid sleeve freely to move laterally, rotatably and axially with respect to said flexible tube and to be impacted by the flexible tune during the operation of the sprinkler to control the movements of the flexible tube and thereby the distribution of the water discharged from said nozzle.

2. The sprinkler according to claim 1, wherein said flexible tube is formed with an annular shoulder engageable with the downstream end of said rigid sleeve to limit the axial movements of the rigid sleeve during the operation of the sprinkler.

3. The sprinkler according to claim 1 wherein the downstream end of said rigid sleeve is cut at a bias to cause the discharged water to trace annular patterns of different configurations and thereby to increase the uniformity of distribution of the water in the water-wetted area around the sprinkler.

4. The sprinkler according to claim 1, further including a second rigid sleeve having its inner end fixed to said nozzle and its outer end projecting outwardly therefrom, said second rigid sleeve having a bore of larger diameter than the discharge opening of said nozzle.

5. The sprinkler according to claim 4, wherein said bore of the second rigid sleeve is of conical configuration, increasing in diameter from its inner end to its outer end.

6. The sprinkler according to claim 1, further including a weight adjacent to the nozzle end of the flexible tube.

7. The sprinkler according to claim 6, wherein said weight includes a cup at the nozzle end of the flexible tube adapted to accumulate water discharged from the nozzle.

8. The sprinkler according to claim 6, wherein said weight is suspended from said sprinkler.

9. The sprinkler according to claim 1, when the sprinkler is form with a restriction in the passageway therethrough for the flow of water, and with a plurality of radially holes therethrough immediately upstream of said restriction for discharging a small quantity of water radially through said holes.

10. The sprinkler according to claim 9, wherein said restriction and radial holes are formed immediately downstream of said first-mentioned rigid sleeve.

11. The sprinkler according to claim 9, wherein said restriction and radial holes are formed in said nozzle.

12. The sprinkler according to claim 1, including a further rigid sleeve slidably received on said flexible tube between said first-mentioned rigid sleeve and said nozzle.

13. The sprinkler according to claim 14, wherein said flexible tube includes a pair of stops for limiting the axial movements of both of said rigid sleeves.

14. The sprinkler according to claim 1, further including a stop laterally of the flexible tube and engageable thereby during the operation of the sprinkler to restrict the free movement of the flexible tube laterally of the sprinkler and thereby to produce an unequal distribution of the water around the sprinkler.

15. The sprinkler according to claim 14, wherein said lateral stop comprises a stop member secured at one end to said connector, the opposite end of said stop being laterally of and engageable by portion of said flexible tube between said rigid sleeve and nozzle.

16. The sprinkler according to claim 14, wherein said flexible tube is divided into a plurality of flexible tube sections each coupled to the next adjacent one by a connector sleeve.

* * * * *

UNITED STATES PATENT AND TRADEMARK OFFICE

CERTIFICATE OF CORRECTION

PATENT NO. : 4,684,066

DATED : August 4, 1987

INVENTOR(S) : Mordechai Uzrad

It is certified that error appears in the above-identified patent and that said Letters Patent is hereby corrected as shown below:

Claim 1, Column 6, line 11, change "flexibe" to -- flexible

Claim 1, Column 6, line 29, change "tune" to -- tube

Claim 9, Column 6, line 64, change "form" to -- formed

Claim 13, Column 7, line 10, change "according to Claim 14" to -- according to Claim 12

Claim 15, Column 8, line 8, change "engageable by portion" to -- engageable by a portion Signed and Sealed this Twenty-second Day of November, 1988

*Attest:*

*Attesting Officer*

DONALD J. QUIGG

*Commissioner of Patents and Trademarks*